US005141461A

United States Patent [19]

Nishimura et al.

[11] Patent Number: 5,141,461

[45] Date of Patent: Aug. 25, 1992

[54] METHOD OF FORMING A METAL-BACKED LAYER AND A METHOD OF FORMING AN ANODE

[75] Inventors: Yutaka Nishimura, Kadoma; Masahide Tsukamoto, Nara; Hirotoshi Watanabe, Osaka; Kohji Matsuo, Neyagawa; Noboru Aikawa, Ibaraki, all of Japan

[73] Assignee: Matsushita Electric Industrial Co., Ltd., Osaka, Japan

[21] Appl. No.: 478,499

[22] Filed: Feb. 12, 1990

[30] Foreign Application Priority Data

Feb. 10, 1989 [JP] Japan ..... 1-31784
Jul. 17, 1989 [JP] Japan ..... 1-184071

[51] Int. Cl.[5] ..... H01J 9/20

[52] U.S. Cl. ..... 445/52; 427/68; 156/87; 313/466

[58] Field of Search ..... 445/52; 427/68; 156/87; 204/15; 313/466

[56] References Cited

U.S. PATENT DOCUMENTS 3,582,389 6/1971 Saulnier ..... 427/68
3,910,806 10/1975 Schwartz ..... 427/68 X
4,025,661 5/1977 Moscony et al. ..... 427/68
4,590,092 5/1986 Giancaterini et al. ..... 427/68
4,849,302 7/1989 Ostwald ..... 204/15 X

OTHER PUBLICATIONS

Laid-Open Japanese Application No. 63-43238.
Nakanishi "Manufacturing a Phosphor Screen for Color CRT" (Unknown Publication) Nov. 14, 1988.

*Primary Examiner*—Kenneth J. Ramsey
*Attorney, Agent, or Firm*—Wenderoth, Lind & Ponack

[57] ABSTRACT

This invention proposes methods of effectively forming a metal-backed layer and an anode using a metal film transferring sheet in which micro-holes are formed. that is, the metal film transferring sheet is structured by forming a metal film on a mold-releasable, highly characteristic sheet. Then, the metal film having micro-holes of the metal film transferring sheet is transferred onto a phosphor screen. Or, on the metal film of the above-mentioned metal film transferring sheet, is formed a phosphor screen and the metal film, the phosphor screen, etc. are all transferred onto a face plate form an anode of a cathode-ray tube. Then the methods proposed by this invention are applied for making phosphor products of, for example, a cathode-ray tube or a plasma display. According to these methods, there is no need to use a large-scaled manufacturing facility and high quality, low cost products can be obtainable.

49 Claims, 9 Drawing Sheets

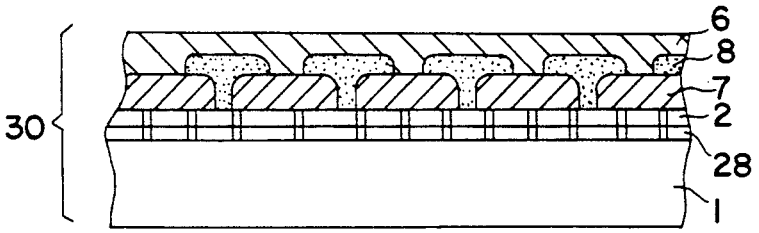
FIG.9(a)
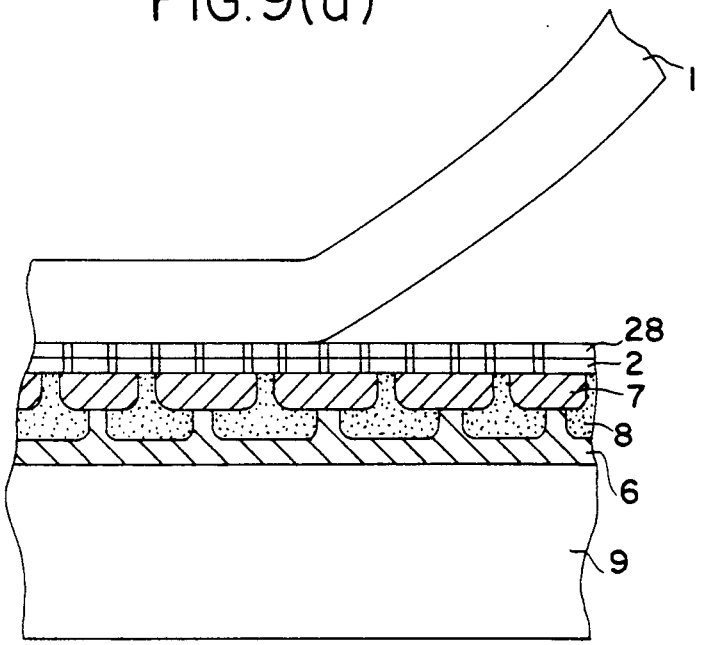
FIG.9(b)
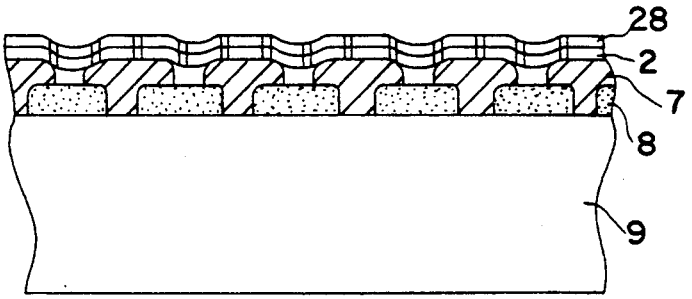
FIG.9(c)
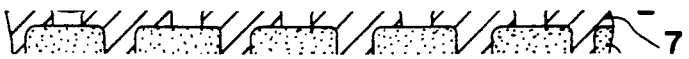

METHOD OF FORMING A METAL-BACKED LAYER AND A METHOD OF FORMING AN ANODE

BACKGROUND OF THE INVENTION

1. Field of the Invention

This invention relates to a method of forming a metal-backed layer and a method of forming an anode.

2. Description of the Prior Art

Cathode-ray tube anodes of conventional color television are formed in the following processes. A glass board having a phosphor screen is suitably surface-treated, then, it is pattern-exposed using a photo-resist of PVA and ammonium dichromate and developed and then, a black material such as, for example, graphite is coated and lifted off thereby to form a black matrix layer. The phosphor pattern formation process is so complex that the coating, drying, exposure, development and drying of a slurry having phosphor pigments dispersed into a PVA-ammonium dichromate photoresist are repeatedly carried out three times to form respective RGB layers. Furthermore, after the phosphor layers have been formed as above, in order to make a mirror-surface metal film, an organic high polymer layer is coated thereon and then, a metal surface is formed on the organic high polymer layer by, for example, the vacuum evaporation or sputtering technique. Then, the baking process is carried out to degrade the organic materials contained therein to form an anode. Also, a method of forming a metal-backed layer has been disclosed by Japanese Patent Application Laid-Open No. 62 - 185833 (Nissha Printing Co., Ltd.), in which, by use of a transferring body having a metal-backed layer on a releasable base film, is transferred to the face plate of a cathode-ray tube to form a metal-backed layer thereon. However, the transferred metal-backed layer thus obtained did not possess satisfactory characteristics. In addition, in the case of a shadow mask color picture tube, 15 to 20% of an electron beam generally passes through a shadow mask to luminate the phosphor and the other 80 to 85% of the electron beam comes into collision with the shadow mask to increase the temperature thereof, so that the shadow mask can be thermally expanded thereby to deform it convexly to the panel face direction. This phenomenon is called doming. If the doming were occur, the positional relation of the mask holes on the face panel is changed, causing a, in an extreme case, color deviation to take place. Thus, it was necessary to prevent the temperature of shadow mask from increasing.

SUMMARY OF THE INVENTION

An object of this invention is to provide improved methods of forming a metal-backed layer and an anode. The conventional anode forming methods require the use of a large number of complicated stops processes as well as expensive large-scaled evaporation or sputtering equipment. In addition, if the baking degradation of the organic materials contained under the metal-backed layer after formation of an anode can not be carried out satisfactorily, blisters will be generated partially or entirely on the metal-backed layer thus formed. This is apparently because gases generated due to the degradation of organic materials are prevented, by the metal-backed layer from escaping smoothly to the outside. Blistering of the metal-backed layer causes a reduction in the reflection efficiency of the phosphor, and decreases the yield. To deal with the doming, a carbon blackening film is formed on the back of an aluminum film of the metal-backed layer. This facilitates the absorption of the radiation heat from the mask on the appearance of the picture. This carbon film serves to reduce the thermal reflection from the aluminum surface, which prevents the temperature of the mask from increasing. Thus, the doming level can be improved and at the same time, the black floating level can also be improved. In this case, however, if a uniform thin coating of the blackening film (radiation heat absorption material) is not formed, a large difference in the transmission efficiency of an electron beam will result, causing the generation of an uneven luminance. The blackening film is generally formed in such a way that a barrier layer is formed on a metal-backed layer by coating an acrylic emulsion by, for example, the spray technique and then, a graphite slurry is spray-coated thereon. Because of the formation of a barrier layer and graphite layer on the metal-backed layer, organic materials contained therein can not escaped in a smooth manner during baking, thereby causing the aluminum film on blistering of the metal-backed layer.

In order to attain the above-mentioned object, a metal-backed layer of this invention is formed as follows: On a mold-releasable sheet with a good mold-releasability there is formed a metal film having micro-holes to make a metal film transferring sheet. Then, a metal film having micro-holes formed on the metal film transferring sheet is transferred onto a phosphor screen. Or, a phosphor screen is formed on the metal film of the metal film transferring sheet, and the metal film and phosphor layers are collected onto a face plate. Further, a resin film having a suitably rough surface as well as good releasability from the metal film, used as a metal-backed layer, is formed on a sheet board and the metal film to be transferred is, formed on the resin film, thus constituting a metal film transferring sheet. Then, the metal film on this metal film transferring sheet is transferred onto a phosphor screen. Still further, a phosphor screen is formed on a metal film on the above-mentioned metal film transferring sheet and the metal film and phosphor screen layer are transferred onto a face plate.

In addition, a black resin layer having a suitably rough surface as well as a good adhesion to the metal film, used as a metal-backed layer is, formed on a highly mold-releasable sheet board. The metal film to be transferred is formed on this black resin layer, thus constituting a metal film transferring sheet. The black resin layer and metal film thus formed on the metal film transferring sheet are transferred onto a phosphor layer. Further in addition, a phosphor layer is further formed on the black resin layer of the metal film transferring sheet mentioned above and the black resin layer, metal film and phosphor layer are transferred onto a face plate.

In addition, a metal film transferring sheet is made by forming a black metal film and a metal film both having micro-holes on a mold-releasable supporting body. The metal film transferring sheet is transferred onto a phosphor layer formed on a glass board and the baking process is carried out for the degradation of organic materials to make the phosphor screen. A phosphor layer and a black matrix layer are formed in this order on a metal film transferring sheet made by forming a black metal film and a metal film both having micro-holes on a mold-releasable supporting body, then, the lower part of the black metal film is collectively transferred onto a glass board and the organic materials contained therein are baked, thus forming an anode. With the above-mentioned structures, the operations will be explained below.

Micro-holes, formed in the metal film serve, to permit gases generated by the degradation of organic materials contained under the metal-backed layer during the baking process, to escape smoothly thereby preventing the damage to the surface of the metal film caused by developing blisters, blister-caused cracks or the like. Also, the formation of the metal film on a resin layer having a suitably rough surface by, for example, the vacuum evaporation technique makes it possible to reduce thickness thereof at the bottoms of the valleys (concave portions) than at the tops of the peaks (convex portions) in the surface irregularities, which means that the metal film thus formed has a large number of thinner portions distributed in a spotted fashion therein. Then, the metal film of this metal film transferring sheet is quickly adhered by means of an adhesive layer to a phosphor screen formed on a glass board. Thereafter, the sheet board is peeled off therefrom, so that a metal film having a large number of thinner portions randomly distributed can be formed on the phosphor screen. These thinner film portions can be easily broken down into the pinhole shapes by the internal pressure of gases generated by the degradation of organic materials during the baking process, leading to an easy escape of the gases therethrough. As a result, the damage to the metal-backed layer due to blisters or blister-caused cracking can be completely prevented. Furthermore, since the breakdown of these thinner film portions is made in the shape of a pinhole, no adverse effects on any function thereof as the metal-backed layer results. Also, there is formed on a mold-releasable sheet, a black resin layer having a suitably rough surface as well as having a good adhesion to a metal layer. A metal film is formed on the black resin layer, constituting the metal film transferring sheet. The metal film obtained when the metal film transferring sheet is transferred onto the phosphor screen has thinner film portions spottedly distributed and on the metal film thus transferred, a black resin layer is formed. That is, an exfoliation takes place between the highly mold-releasable sheet and the black resin film so that the black resin layer and the metal film are transferred to the glass board side. The metal film thus transferred has a large number of thinner film portions spotted distributed as described above. Such thinner film portions can be broken down in a pinhole shape by the internal pressure of gases generated by the thermal degradation of organic materials during the baking process, thereby permitting the gas to escape therethrough. As a result, any damage to the metal-backed layer, due to blisters or blister-caused can be completely prevented. Furthermore, since the breakdown of these thinner film portions is made in the shape of pinholes, no adverse effects on any function thereof as a metal-backed layer results. Also, on the metal film, thus transferred, is formed a black resin layer which serves to absorb the radiation heat from the shadow mask. In addition, the thermal reflection from the aluminum face can be reduced so that the temperature rise of the shadow mask can be suppressed and occurrence of doming can be prevented, leading to an improvement in picture quality. In addition, even the secondary electron beam reflected from the aluminum face can be absorbed by the black resin layer, leading to the obtainment of a clear picture image. According to the method of this invention, by coating a black resin layer having the required thickness necessary to prevent doming on the aluminum face, a black resin layer with a uniform thickness can be easily formed on the aluminum face. Also, even when a metal film transferring sheet, obtained by the formation a black metal film having micro-holes and a normally lustrous metal film having micro-holes in this order on a mold-releasable supporting body is used, the same effects as shown above can be provided in which blisters are prevented due to the effect of the pre-perforated micro-holes during baking and the doming can be prevented by the effect of the black metal film. In addition, the transfer of the phosphor screen forming sheet having a phosphor pattern formed on a metal film transferring sheet, onto the face plate for making an anode, makes possible a large reduction in the number of processes to be required.

BRIEF DESCRIPTION OF THE DRAWINGS

FIG. 1 (*b*) is a cross-sectional view of a metal film transferring sheet which is made by forming micro-holes into the metal film transferring sheet shown in FIG. 1 (*a*);

FIG. 1 (*c*) is a diagram showing an anode formation process using the metal film transferring sheet shown in FIG. 1 (*b*);

FIG. 1 (*d*) is a cross-sectional view of a metal film transferring sheet having a release layer formed between a supporting body and a metal film;

FIG. 1 (*e*) is a cross-sectional view of a baked anode;

FIG. 2 (*b*) is a diagram showing a forming process of micro-holes into the metal film transferring sheet shown in FIG. 1 (*a*) by forming the micro-projections body toward it;

FIG. 3 (*a*) is a cross-sectional view of an anode forming sheet, FIG. 3 (*b*) is a diagram showing an anode formation process using the anode forming sheet shown in FIG. 3 (*a*) and FIG. 3 (*c*) cross-sectionally shows a baked anode;

FIG. 4 (*a*) is a cross-sectional view of a metal film transferring sheet of this invention on which a resin layer having a rough surface is formed; FIG. 4 (*b*) is a cross-sectional view of a metal film transferring sheet which is made by forming a release layer on the metal film transferring sheet shown in FIG. 4 (*a*); FIG. 4 (*c*) illustrates an anode formation process using the metal film transferring sheet shown in FIG. 4 (*a*); and FIG. 4 (*d*) is a cross-sectional view of an anode formed by baking;

FIG. 5 (*b*) is a diagram showing an anode formation process;

FIG. 5 (*c*) is a cross-sectional view of a baked anode;

FIG. 6 (*a*) is a cross-sectional view of a metal film transferring sheet; FIG. 6 (*b*) illustrates an anode formation process; and FIG. 6 (*c*) cross-sectionally shows a baked anode;

FIG. 7 (*a*) is a cross-sectional view of an anode forming sheet; FIG. 7 (*b*) is an anode formation process diagram; and FIG. 7 (*c*) is a cross-sectional view of an anode obtained by baking;

FIG. 8 (*a*) is a cross-sectional view of a metal film transferring sheet; FIG. 8 (*b*) is a cross-sectional view of a metal film transferring sheet which is made by forming micro-holes into the metal film transferring sheet shown in FIG. 8 (*a*); and FIG. 8 (*c*) is an anode formation process diagram;

FIGS. 9 (*a*) to (*c*) illustrate an anode formation process using the metal film transferring sheet shown in FIG. 8 (*a*); FIG. 9 (*b*) is a cross-sectional view of an anode forming sheet; FIG. 9 (*b*) is an anode formation process diagram; and FIG. 9 (*c*) is a cross-sectional view an anode obtained after baking.

DESCRIPTION OF THE PREFERRED EMBODIMENTS

Figure 1A:
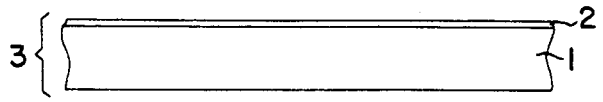
FIG. 1 (*a*) is a cross-sectional view of a metal film transferring sheet of this invention.
Figure 1B:
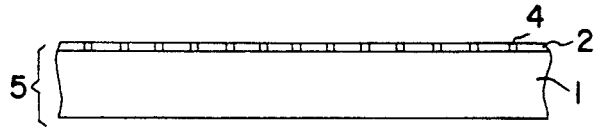
Figure 1C:
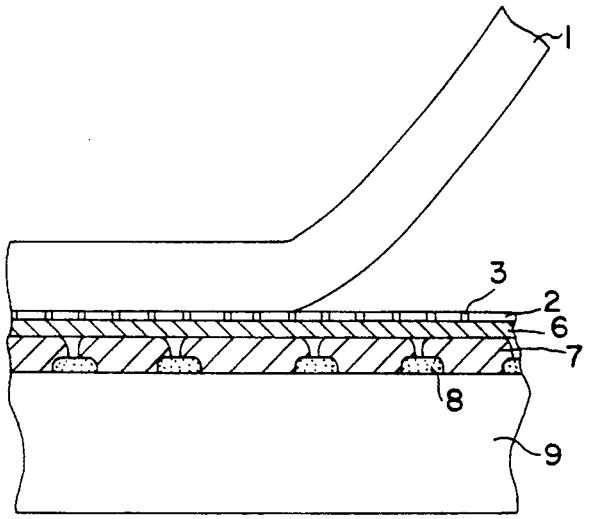
Figure 1D:
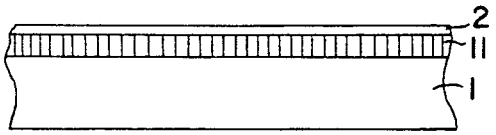
Figure 1E:
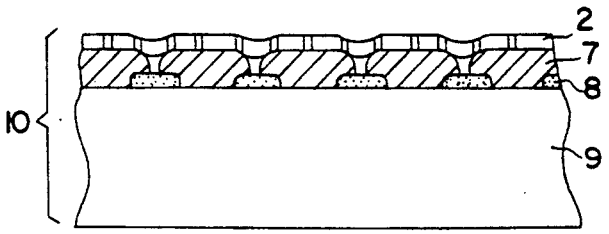

Hereinafter, descriptions will be made on a metal film transferring sheet of this invention and its manufacturing method and a forming method of an anode while referring to the drawings.

FIRST EMBODIMENT

Descriptions on this FIRST EMBODIMENT will be made in outline first and then, in detail as follows: FIG. 1 (*a*) is a cross-sectional view of a metal film transferring sheet 3 of this invention. In FIG. 1 (*a*), the reference numeral 1 indicates a mold-releasable sheet which is superior in mold-releasability, mechanical strength and solvent resistance, for which various kinds of resin film made, for example, of polyimide, polyethylene, polypropylene or the like are used in general. The thickness of this film normally could range from 3 to 100 μm, preferably ranging from 5 to 50 μm. Also, the mold-releasable sheet 1, as shown in FIG. 1 (*d*), can be made by forming a mold-release layer 11 on a sheet. The mold-release sheet 11 can be advantageously made of a highly mold-releasable resin such as, for example, silicone, teflon, acryl or wax.

Figure 2A:
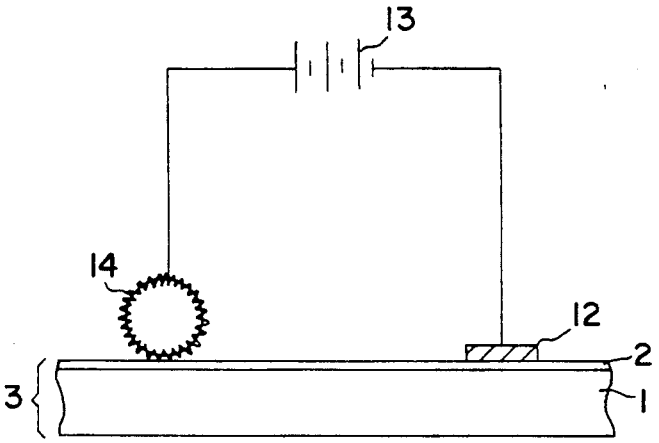
FIG. 2 (*a*) illustrates a forming process of micro-holes into the metal film transferring sheet shown in FIG. 1 (*a*) by an electron discharge method.
Figure 2B:
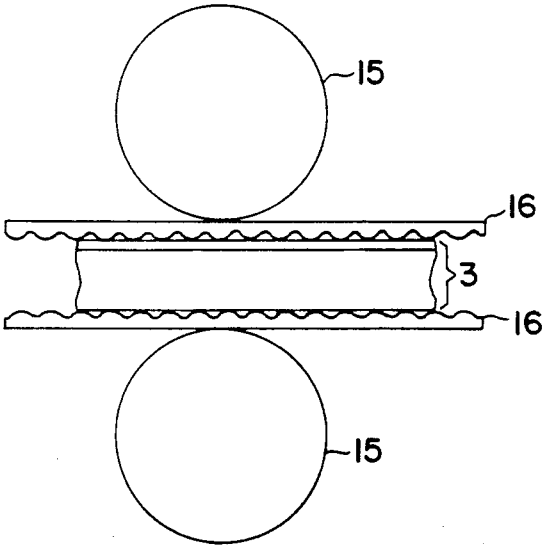

The numeral 2 is a metal film obtained by vacuum evaporation, which has a metallic luster. FIG. 1 (*b*) is a cross-sectional view of a metal film transferring sheet 5 which has micro-holes 4 formed in the metal film of the metal film transferring sheet 3 shown in FIG. 1 (*a*). Referring to the size of the micro-holes 4, it is preferable to make them as small as possible to prevent a reduction in luminance, by maintaining them below 50 μm in diameter, preferably in a range of from 5 to 30 μm. If such micro-holes can be formed uniformly in the metal film, the generation of blisters on the surface of the metal film can be prevented in the baking process at 450° C. as the final process, resulting in the obtainment of a highly performable metal-backed layer. FIG. 1 (*c*) illustrates that the metal film transferring sheet 1 is adhered via an adhesive layer 6 to a glass board 9 having a black matrix layer 8 and a phosphor layer 7, and then, the metal film 2 is transferred to the phosphor 7 by peeling the mold-releasable sheet 11 therefrom. Due to the mold-releasable effect of the mold-releasable sheet 1, the metal film 2 having micro-holes 4 formed is released from the metal film transferring sheet 5 thereby to transfer it to the phosphor layer 7, thus being capable of forming the metal-backed layer of this invention. After formation of the metal-backed layer, it is baked at 450° C., thus obtaining an anode of a cathode-ray tube as shown in FIG. 1 (*d*). In FIG. 1 (*e*), 9 is a glass board which is called a face plate, 8 is a black matrix layer made of a light absorptive material, 7 is a phosphor layer which emits a light by a n electron beam, and 2 is a metal-backed layer which reflects a light emitted from the phosphor layer 7 to the front side by the mirror-action of the metal film to improve the luminance. Micro-holes 4 were formed in a metal-backed layer in such a way that a cylindrical electrode 14 having micro-holes on its cylindrical surface is contacted with the metal film 2 of the metal film transferring sheet 3 as shown in FIG. 2 (*a*) and a voltage of 10 to 30 V is applied for discharging thereby to form such micro-holes 4 in the metal film 2. In addition, micro-holes formation was possible, as shown in FIG. 2 (*b*), in such a way that the metal film transferring sheet 3 is supportedly placed between sheets having micro-projections (sand-paper) and rolled under the application of pressure using a rolling machine 15. Further in addition, micro-scratches formed on the surface of the metal film using a sand-blast can be used for such micro-holes. Micro-holes thus formed in the surface of the metal film were able to function so as to provide us with a metal-backed layer with no generation of blisters as well as with an outstanding surface finish.

Next, description of this FIRST EMBODIMENT will be set forth in detail.

The thickness of the mold-releasable sheet 1 could range form 3 to 100 μm, preferably ranging from 5 to 50 μm. In this embodiment, a polyimide film of 12 μm thick was used. On this mold-releasable sheet 1 was formed an aluminum film of 800 Å 3 by vacuum evaporation. Next, the method of forming micro-holes 4 in the metal film transferring sheet 3 will be explained. As shown in FIG. 2, the cylindrical electrode 14 having micro-projections was contacted with the metal film 2 of the metal film transferring sheet 3 and a voltage of 10 to 30 V was applied thereto for discharging thereby to form micro-holes. The cylindrical electrode 14 was rotated and the frequency of discharge was changed from one to five times, thus metal film transferring sheets 5 respectively differing in the number of micro-holes to be formed thereinto being prepared. In order to quantitatively analyze the conditions of the micro-holes thus formed, their aperture ratio and size were measured by the SUPER IMAGE ANALYZER made by NIRECO. A metal film transferring sheet having micro-holes formed as shown above was adhered via an acrylic adhesive layer 6 to the phosphor layer 7 formed on the glass board 9 by the prior art thereby transferring the metal film 2 having micro-holes onto the phosphor layer 7, and then, the mold-releasable sheet was peeled off therefrom, thus a phosphor screen having a metal-backed layer formed on the glass board 9. Furthermore, the above-mentioned anode was baked at 450° C. for thermal degradation of organic materials, thus forming an anode of a color cathode-ray tube. In this case, however, the surface condition of the metal-backed layer obtained after baking was largely varied depending on the dimensional condition of the micro-holes formed in a vacuum-evaporated aluminum film as shown in Table 1. This is because the dimensional condition plays a largely effective role on degassing. If the micro-holes thus formed effectively serve to act as a degassing hole during baking, the metal film can be completely prevented from blistering, which makes possible the formation of a highly performable metal-backed layer. However, if the aperture ratio of micro-holes is unsatisfactory, a large number of blisters or blister-caused cracks appears on the metal film surface. Table 1 comparatively shows the relation of the discharge frequency, the aperture ratio and the condition of the metal film after baking.

TABLE 1

| Discharge frequency (times) | Aperture ratio (%) | Condition after baking |
|---|---|---|
| 0 | 0 | x |
| 1 | 3 | Δ |
| 2 | 5 | ○ |
| 3 | 7 | ○ |
| 4 | 10 | ⊙ |
| 5 | 12 | ⊙ |
| 6 | 15 | ⊙ |

As clear from Table 1, when no micro-holes were formed in the aluminum film, blisters were generated all over the surface thereof. In the case of forming micro-holes in the aluminum film by the discharge technique, though slight amounts of blisters were generated when it was carried out only one time, when it was done more than two times, highly performable metal films were obtained. Referring to the diametric size of the micro-holes thus formed, it was about 15 μm in average and if it exceeded 50 μm, the luminance was reduced. The baking conditions thereof were that the temperature is gradually elevated at 10° C./min. to 450° C. and held at that temperature for one hour. From the results thus obtained, if the aperture ratio was larger than 5%, a highly performable metal-backed layer can be obtained after baking.

SECOND EMBODIMENT

Next, an anode forming method using a metal film transferring sheet 5 which has micro-holes formed by applying micro-projections under pressure as shown in FIG. 2 (*b*) will be explained.

A metal film transferring sheet 3 obtained by the method in FIRST EMBODIMENT was supportedly placed between two sand-papers 16 (#1,000) and a rolling machine 15 was set at a linear pressure of 4 kg/cm$^2$. The metal film transferring sheet 3 thus supportedly placed between the two sandpapers was passed five times through between the rollers of the rolling machine 15, thus, a metal film transferring sheet having micro-holes with an aperture ratio of 10% and an average diameter of 10 to 20 μm was obtained. In addition, in the same way as in FIRST EMBODIMENT, the metal film transferring sheet thus obtained was transferred under the application of pressure onto a phosphor layer 7 formed on a glass board 9, and the baking process was carried out at 450° C. for one hour. The metal-backed layer thus obtained was strong in adhesion and superior in property.

THIRD EMBODIMENT

A metal film transferring sheet 3 obtained by the method shown in FIRST EMBODIMENT was subjected to a sandblast process using Carborumdom grains of #1,500 pass (1 μm in average grain size) in a sandblast machine made by COMCO Corp. Thus, micro-holes with an average diameter of 5 to 8 μm and an aperture ratio of 8% were formed into the metal film transferring sheet 3.

The sheet thus obtained was transferred onto a phosphor layer 7 under the application of pressure in the same way as in FIRST EMBODIMENT, and the baking process was carried out at 450° C. for one hour. Thus, a strongly adhered and highly performable metal-backed layer was obtained.

FOURTH EMBODIMENT

The FOURTH EMBODIMENT will be explained while referring to FIG. 3.

Figure 3A:
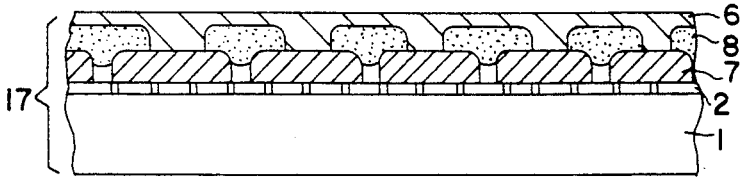
FIGS. 3 (*a*) to (*c*) are diagrams showing an anode formation process using an anode forming sheet.
Figure 3B:
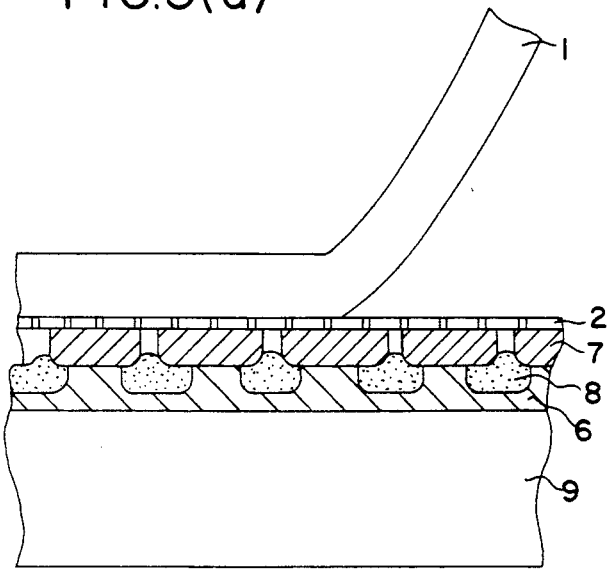
Figure 3C:
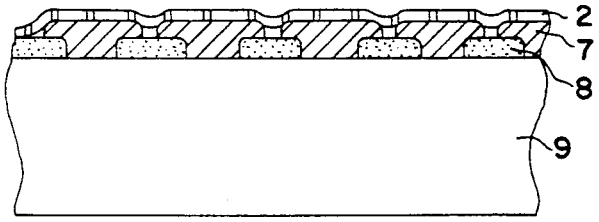
Figure 4A:
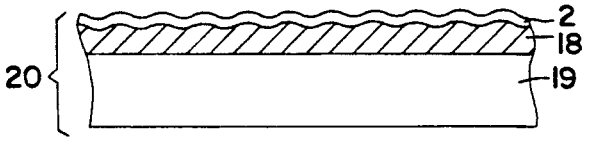
FIGS. 4 (*a*) to (*d*) are diagrams showing an anode formation process using a metal film transferring sheet according to another embodiment of this invention.
Figure 4B:
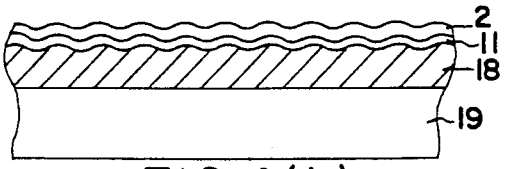
Figure 4C:
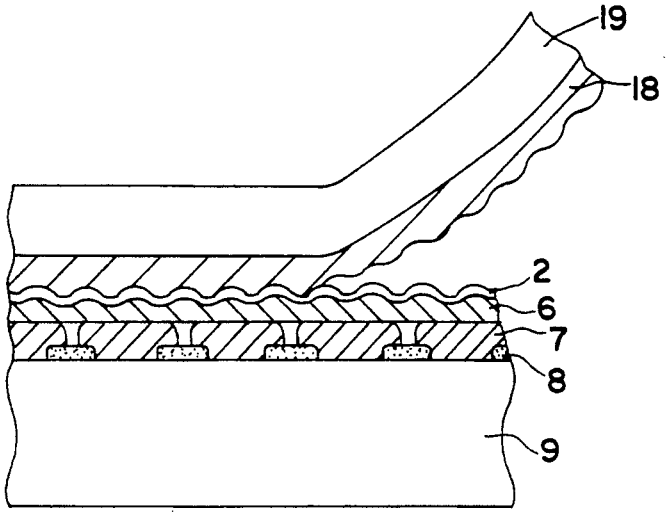
Figure 4D:
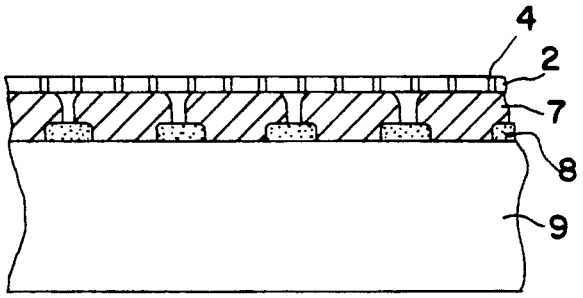

In this FOURTH EMBODIMENT, as shown in FIG. 3 (*a*), a phosphor layer 7 and a black matrix layer 8 were formed on a metal film transferring sheet 5 structured as shown in FIG. 1 (*b*) of the FIRST EMBODIMENT thereby to make an anode forming sheet 17. The anode forming sheet 17 thus made was adhered via an adhesive layer 6 to the glass board 9, and then, a mold-releasable sheet 1 was peeled therefrom as shown in FIG. 3 (*b*). Thus, the anode forming sheet 17 was exfoliated from a metal film 2 having micro-holes thereby to form an anode on the glass board 9.

A detailed description of this embodiment will be made below.

For a metal film transferring sheet 3 obtained in the FIRST EMBODIMENT of this invention was applied the discharge machining technique to make a metal film transferring sheet 5 having micro-holes with an aperture ratio of 10%.

Furthermore, the following composition was passed three times through a three-ceramic-roller mill for milling thereby preparing a green phosphor ink.

| | |
|---|---|
| Green phosphor (ZnS/Cu) | 70 (weight part) |
| Acrylic resin | 10 (weight part) |
| Solvent | 18 (weight part) |
| Dispersant | 2 (weight part) |

In the same way as above, a red phosphor ink and blue phosphor ink were prepared.

The metal film transferring sheet 5 having micro-holes formed as shown in FIG. 1 (*b*) was fixed on a glass board and a green phosphor pattern was printed thereon by the gravure-offset technique. A red phosphor pattern and blue phosphor pattern were printed in position successively, thus a RGB three-color phosphor pattern was obtained. The patterns thus printed resulted in the obtainment of a stripe with satisfactory uniformity, accuracy and optical characteristics.

In addition, the black matrix layer was made of the following composition and continuously printed on an aluminum transferring sheet by the same gravure-offset method as in printing the phosphor pattern.

| | |
|---|---|
| Graphite | 25 (weight part) |
| Acrylic resin | 33 (weight part) |
| Solvent | 40 (weight part) |
| Linseed oil | 2 (weight part) |

An acrylic adhesive was coated at a uniform thickness of 3 μm on the top surface of the anode forming sheet 17 which was obtained by printing the phosphor layer 7 and black matrix layer 8 on the metal film transferring sheet 5 haivng micro-holes thereby to prepare an adhesive layer 6. The anode forming sheet 17 was adhered via the adhesive layer 6 to the glass board 9 to be used as the face plate. Then, the mold-releasable sheet 1 of the anode forming sheet 17 was peeled therefrom so that the black matrix layer 8, phosphor layer 7 and the metal film 2 having micro-holes could be formed on the glass board 9. Then, the baking process was carried out under conditions that the temperature is elevated at 10° C./min. to 450° C. and held at this temperature for one hour. Thus, a metal film 2 as a metal-backed layer having a good black matrix layer 8 and phosphor layer 7 as well as having micro-holes formed was obtained so that a good anode could be formed as shown in FIG. 3 (*c*). The anode thus obtained could provide us with suitable characteristics to be used as an anode of a color cathode-ray tube.

FIFTH EMBODIMENT

The FIFTH EMBODIMENT of this invention will be explained while referring to FIG. 4.

FIG. 4 (*a*) is a cross-sectional view of a metal film transferring sheet 20 of this invention. In FIG. 4 (*a*), 19 is a sheet board superior in mechanical strength and solvent resistance, which is made of resin such as, for example, a polycarbonate, polyethylene terephthalate (PET), polyacetal, polyamide or the like, and 2 is a metal film formed by, for example, vacuum evaporation, sputtering or the like. 18 is a resin layer having a rough surface, preferable by use of thermally degradable acrylic resin as a binder. FIG. 4 (*b*) is a cross-sectional view of a metal film transferring sheet having a mold-release layer 11 formed between the metal film 2 and the resin layer 18.

FIG. 4 (*c*) illustrates that the metal film transferring sheet 20 adhered via an adhesive layer 6 to a glass board 9 having a black matrix layer 8 and a phosphor layer 7 and then, the metal film 2 on the metal film transferring sheet 20 is transferred onto the phosphor layer 7 by peeling the sheet board 19 therefrom. The resin layer 18 is, as will be described in detail later, made of a material highly releasable from the metal film 2 as the binder, which includes silicone, an acryl, wax, fluorine or the like, so that the metal film 2 can be peeled off from the resin layer 18 to transfer it onto the phosphor layer 7. Thus, a metal-backed layer as an object of this invention can be formed with the metal film 2. FIG. 4 (*d*) is a cross-sectional view of an anode after baking.

Further description will be made on this embodiment.

The thickness of the sheet board 19 can be of 3 to 100 μm in general, preferably ranging from 5 to 50 μm. In the FIFTH EMBODIMENT, a polyethylene terephthalate film of 25 μm thick was used. The resin layer 18 was formed by coating a paint, which was prepared by adding silica of 5 μm in average particle size at 20 weight percent to an acrylic resin as the mother material and the mixture thus obtained was kneaded for 20 minutes in a homomixer, on the sheet board 19 up to a thickness of 3 μm using a wire bar. On the surface of the resin layer 18 having a thickness smaller than the average particle size of silica powder, a large number of silica particles, each having the surface covered with an acrylic resin can be surely projected, so that a rough surface having a suitable irregularity can be obtained. The surface roughness thereof was 150 sec. in terms of the Beck smoothness. Next, an aluminum film was formed on the resin layer 18 by vacuum evaporation. The thickness of the metal film thus formed is larger at the tops of the peaks (convex portions) than at the bottoms of the valleys (concave portion) of the surface irregularities thereof. In this embodiment, it was about 1,000 Å at the tops and about 200 to 300 Å at the bottoms. As shown above, the thickness of the metal film 2 is affected by the surface roughness of the resin layer 18 so that a thinner film part can be predominantly formed at a position where it is concave. Then, an adhesive of vinyl acetate resin was coated on the phosphor layer 7 to form an adhesive layer 6 and the metal film 2 formed on the resin layer 18 was transferred thereto under the application of pressure by the method as shown in FIG. 4 (*c*), and thus an anode having the metal-backed layer 2 is formed on the glass board 9. For comparison purposes, a resin layer with no content of silica was used. That is, an anode obtained by transferring an aluminum film formed on the resin layer with a smooth surface by vacuum evaporation (hereinafter called the COMPARATIVE EXAMPLE) was formed on the glass board 9 in the same method. During the baking process, it was microscopically confirmed that micro-holes of 5 to 10 μm in diameter of the metal film of the anode of this embodiment were perforatedly formed thereinto at about 250° C., while it was microscopically recognized that no micro-holes were formed in the metal film of the anode of the COMPARATIVE EXAMPLE, but that a large number of small blisters were developed. When the temperature was further increased to 450° C. and held at this temperature for one hour for baking, in the case of this embodiment, the organic materials contained into the adhesive layer 6 or the like were completely burnt and thermally degraded. The aluminum film thus obtained had no evidence of blister generation and retained a metallic lustrous surface condition, resulting in the obtainment of a good anode. On the contrary, the anode of the COMPARATIVE EXAMPLE resulted in the generation of large blisters all over the surface of the aluminum film, out of which some blisters were recognized to be exploded. As explained above, in this embodiment, thinner film parts spottedly distributed all over the metal film surface are broken down by the pressure of gases generated from the organic materials (for example, adhesive agent) existing under the metal film thereby to form a large number of pinhole-shaped micro-holes during the baking process, which serve to completely prevent the metal film from blistering. Contrary to this, in the case of the COMPARATIVE EXAMPLE, no micro holes in the metal film were not formed, thereby causing blisters or blister-caused damage to the metal film. Then a metal film obtained in this embodiment was confirmed to have characteristics suitable for use as a metal-backed layer of a cathode-ray tube and an anode obtained in this embodiment also was confirmed to satisfy the optical characteristics such, as luminance, chromaticity and so on. In addition, various kinds of pigments other than silica can be used to make the rough surface in this embodiment. Further in addition, the surface roughness of the resin layer of this embodiment depends on the particle size and content of the pigments used. Of which, the particle size can be below 50 μm, preferably below 30 μm. In such a case, if the surface roughness of a resin layer is below 400 sec. in terms of the Beck smoothness, then, preferably micro-holes of 5 to 30 μm in diameter can be formed thereinto after baking. As shown in FIG. 4 (*b*), it is also possible to thinly coat a release agent on the resin layer 18 and to form a metal film thereon to improve the releasability between the resin layer and metal film in the transferring process.

SIXTH EMBODIMENT

Figure 5A:
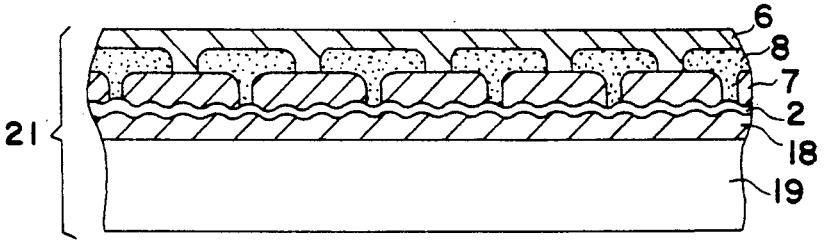
FIG. 5 (*a*) is a cross-sectional view of an anode forming sheet.
Figure 5B:
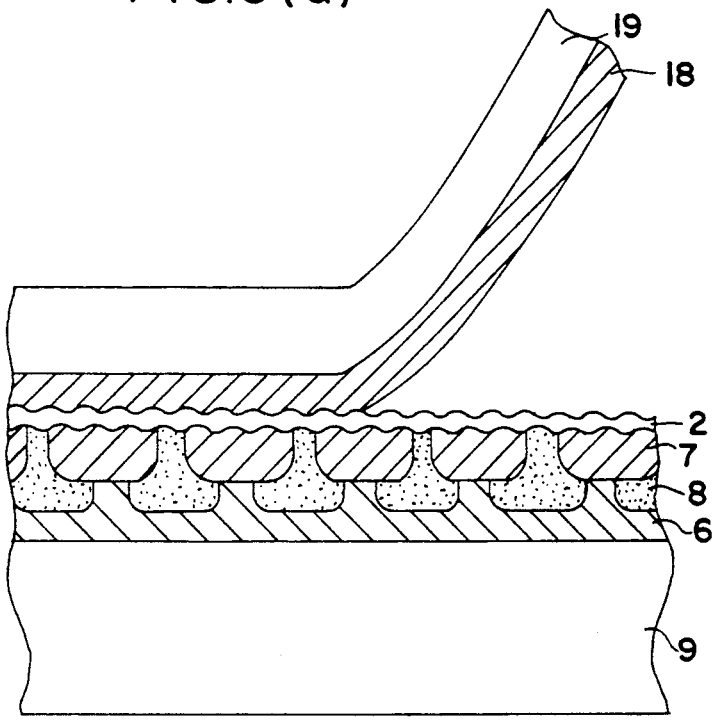
Figure 5C:
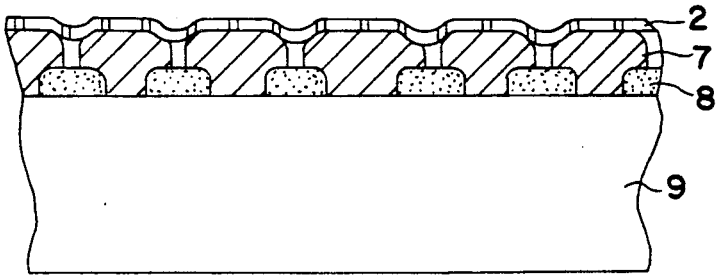

The SIXTH EMBODIMENT will be explained while referring to FIG. 5 as follows:

In the SIXTH EMBODIMENT, as shown in FIG. 5 (*a*), a phosphor layer 7 and a black matrix layer 8 were successively formed on a metal film transferring sheet 20 as structured as shown in the FIFTH EMBODIMENT to make an anode forming sheet 21. The anode forming sheet 20 thus obtained was adhered by means of the adhesive layer 6 to a glass board 9 and then, a sheet board 19 was peeled therefrom as shown in FIG. 5 (*b*). In this case, exfoliation took place between a metal film 2 and the resin film 18, thus forming an anode on the glass board 9. A detailed description will be made below.

On the sheet board 19 of a PET film of 12 μm thick was coated a silicone film containing magnesium carbonate at 15 weight percent up to 2.5 μm thick as a rough surface making agent thereby to form the resin layer 18. The surface roughness of the resin film 18 was 150 sec. in terms of the Beck smoothness. On this resin layer, an aluminum film was coated by vacuum evaporation so as to have a thickness of 1,000 Å as the maximum at positions where it is convex, thus forming the metal film 2. Similar to the case of the FIFTH EMBODIMENT, the thicker film parts were obtained at the tops of peaks (convex portions) of the surface irregularity, while thinner film parts were obtained at the bottoms of valley (concave portions) thereof. In addition, the same phosphor composition as that used in the FOURTH EMBODIMENT was milled by a three-ceramic-roller mill to prepare a phosphor ink.

The metal film transferring sheet 19 having a metal film 2 formed on the resin film 18 was fixed on a glass board and a green phosphor pattern was printed on the metal film transferring sheet 19 by the gravure-offset technique. A red phosphor pattern and a blue phosphor pattern were successively printed on the metal film transferring sheet 19, thus obtaining a RGB three-color phosphor pattern. The patterns thus printed resulted in obtaining a stripe with satisfactory uniformity, accuracy and optical characteristics.

In addition, a black matrix ink was prepared using the same composition as that used in FOURTH EMBODIMENT and continuously printed on the anode forming sheet 21 by the same gravure-offset technique as used in patterning the phosphor pattern. An acrylic adhesive was coated up to a uniform thickness of 3 μm on the top surface of the anode forming sheet 21 which was obtained by printing the phosphor layer 7 and the black matrix layer 8 on the metal film transferring sheet 20. The anode forming sheet 21 was adhered, via the adhesive layer 6 thus coated, to the glass board 9 as the face plate. Then, the sheet board 19 on which the resin layer 18 was formed was peeled therefrom, and the black matrix layer 8, the phosphor layer 7 and the metal-backed layer 2 were transferred onto the face plate. Then, the baking process was carried out under conditions that the temperature is elevated at 10° C./min. to 450° C. and held at this temperature for one hour. Thus, the black matrix layer 8, phosphor layer 7 and metal film 2 were obtained as shown in FIG. 5 (*c*), resulting in the obtainment of a good anode. The anode thus obtained could provide us with suitable characteristics to be used as an anode of a color cathode-ray tube. In this case, it is needless to say that an acrylic adhesive film can be coated on a glass board as the face plate in advance.

SEVENTH EMBODIMENT

Figure 6A:
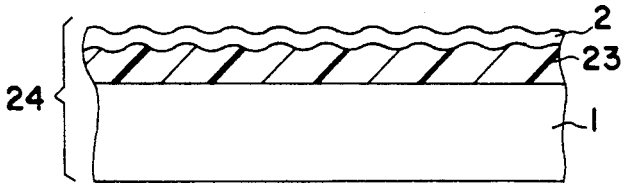
FIG. 6 (*a*) to (*c*) are diagrams showing an anode formation process using a metal film transferring sheet according to another embodiment of this invention.
Figure 6B:
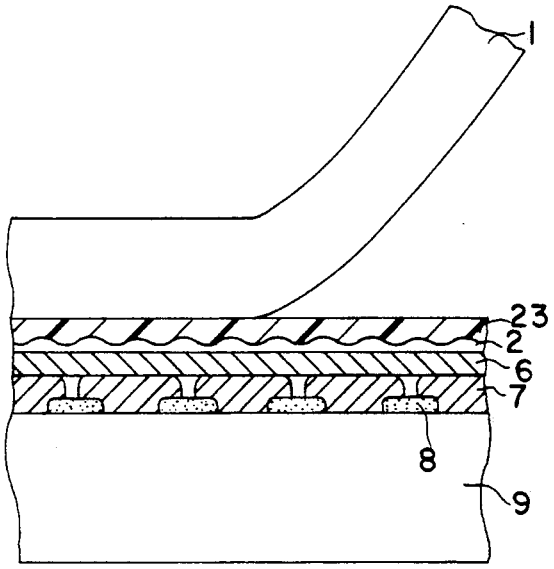
Figure 6C:
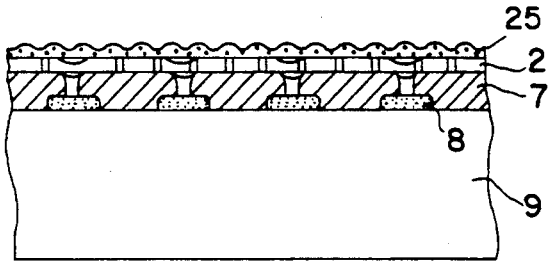

FIG. 6 (*a*) cross-sectionally shows a metal film transferring sheet 24 according to the SEVENTH EMBODIMENT of this invention. In FIG. 6 (*a*), the reference numerals 1, 2 and 23 are a mold-releasable sheet superior in mechanical strength, solvent resistance and mold-releasability, a metal film formed by, for example, vacuum evaporation or sputtering, and a black resin layer containing graphite and carbon and having a rough surface, respectively. An acrylic resin superior in thermal degradation property is preferable to be used as a binder of the black resin layer 23.

FIG. 6 (*b*) illustrates that the metal film transfer sheet 24 is adhered via an adhesive layer 6 to a glass board on which a black matrix layer 8 and a phosphor layer 7 are formed, and then the mold-releasable sheet 1 is peeled therefrom, thereby transferring the black resin layer 23 and metal film 2 formed on the metal film transferring sheet 24 onto the phosphor layer 7.

The black resin layer 23, though explained in detail later, is superior in adhesion to the metal film 2 and extremely inferior in adhesion to the mold-releasable sheet 1, so that the black resin layer 23 and the metal film 2 can be exfoliated from the mold-releasable sheet 1 to transfer onto the phosphor layer 7. As a result, on the phosphor layer 7 can be formed a metal-backed layer having a black resin layer 23 which is an object of this invention.

This embodiment will be explained in detail as follows;

The thickness of the mold-releasable sheet 1 normally can range from 3 to 100 μm, preferably ranging from 5 to 50 μm. In this embodiment, a polyethylene film of 25 μm thick was used. The black resin film 23 was made in such a way that 20 weight parts of graphite of 1 μm in average particle size, 5 weight parts of carbon black of 1 μm in average particle size and 1,000 weight parts of a toluene as a solvent are added to 100 weight part of an acrylic resin as the mother material, the mixture thus obtained is kneaded in a homomixer for 20 minutes to prepare a paint to be used, and the paint thus prepared is coated using a wire-bar on the mold-releasable sheet 1 upto a thickness of 2 μm. The surface of thus coated film is appropriately irregular and colored in black due to the addition of plate-crystalline graphite and finely powdered carbon black. The surface roughness was 200 sec. in terms of Beck smoothness. Next, on the black resin film 23 was formed an aluminum film 2 by vacuum evaporation. The thickness of this metal film 2 was larger at the tops of peaks (convex portions) and smaller at the bottoms of valleys of the surface irregularity of the black resin film 23. In this embodiment, a thickness of about 1 ,000 Å was obtained at the tops of the peaks and a thickness of about 200 to 300 Å was obtained at the bottoms of the valleys. As explained above, the thickness of the metal film 2 was affected by the surface irregularity of the black resin film 23, thus a large number of thinner film parts was obtained at positions where it is concave. Thereafter, an adhesive layer 6 of the vinyl acetate system was coated on the phosphor layer 7, and as shown in FIG. 6 (*b*), the black resin layer 23 and the metal film 2 formed on the mold-releasable sheet 1 were transferred via the adhesive layer 6 onto the phosphor layer 7. Thus, an anode having a metal-backed layer 2 with the black resin layer 23 was formed on the glass board 9. In addition, an anode obtained by transferring an aluminum film formed by vacuum evaporation on a resin film not containing graphite and carbon black, that is, having a smooth surface, which is hereinafter called the COMPARATIVE EXAMPLE, was formed on a glass board by the same method for comparison purposes. During the baking process, the metal film of the anode of this embodiment was microscopically confirmed to here micro-holes of 5 to 10 μm in diameter formed therein at about 250° C. On the other hand, the metal film of an anode of the COMPARATIVE EXAMPLE was microscopically recognized to have no micro-holes formed, but rather a large number of small blisters are developed. When the temperature was further increased to 450° C. and held at this temperature for one hour, in the case of this embodiment, organic materials contained in the adhesive layer 6 or the like were completely burnt and thermally degraded. Thus, the aluminum film thus obtained had no evidence of blister generation and retained an outstandingly good surface finish. Also, referring to the black resin film 23, the binder was completely thermally degraded thereby to form a black layer 25 made of graphite and so on. Therefore, a good anode as shown in FIG. 6 (*c*) was obtained. Contrary to this, the anode of the COMPARATIVE EXAMPLE resulted in the generation of large blisters all over the surface of the aluminum film, out of which some blisters were recognized to be exploded. As described above, in this embodiment, thinner film parts spottedly distributed all over the metal film surface were broken down by the pressure of gases generated from organic materials (for example, adhesive agent), existing under the metal film, to form a large number of pinhole-shaped micro-holes during the baking process, which serves to completely prevent the metal film blistering. Contrary to this, in the case of the COMPARATIVE EXAMPLE, no formation of such micro-holes in the metal film resulted, causing blisters or blister-caused damage to the metal film to take place. The metal film obtained in this embodiment was confirmed to have suitable characteristics to be used as a metal-backed layer of cathode-ray tube and by the effect of a black layer made of graphite and so on, doming could be suppressed and the secondary electron beam absorbed by this black layer, leading to the obtainment of a clear picture image. The method of this embodiment makes possible a large reduction in the number of process as well as a large reduction in cost. Compare this method with the prior art in which a phosphor screen is formed on a glass board using well-known technologies, then, an organic film is formed on the phosphor layer for the sake of a smooth surface formation, a glass board having formed the phosphor layer and an organic film is introduced into a vacuum evaporation apparatus for vacuum-evaporating an aluminum film and a black resin layer formed on the aluminum film by, for example, the spray method to make a black layer. In addition, the surface roughness of the black resin layer of this embodiment depends on the graphite content ranging from 2 to 50 weight percent, preferably ranging from 5 to 30 weight percent. With the composition of graphite in the preferable range, if the surface roughness thereof is below 400 sec. in terms of Beck smoothness, highly functionable micro-holes of 5 to 30 μm in diameter can be formed in a baked metal film. Also, we confirmed that when a metal film is made of nickel, an outstanding metal-backed layer can be produced. In addition, in case that the sheet board is nonadhesive in respect to the black resin layer, the metal film and the black resin layer can be transferred even when a mold-releasable layer is not particularly formed. Further in addition, the metal film and a part of the black resin layer can be transferred by effecting place a flocculation fracture in the black resin layer.

EIGHTH EMBODIMENT

Figure 7A:
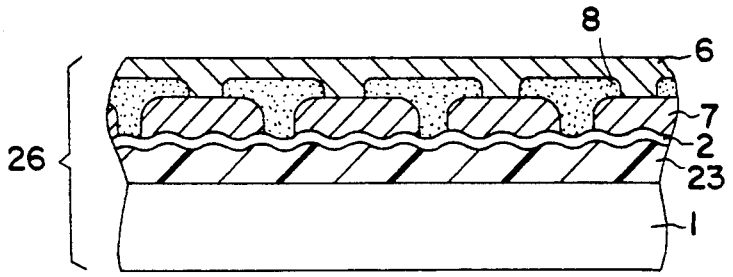
FIGS. 7 (*a*) to (*c*) illustrate an anode formation process using an anode forming sheet.
Figure 7B:
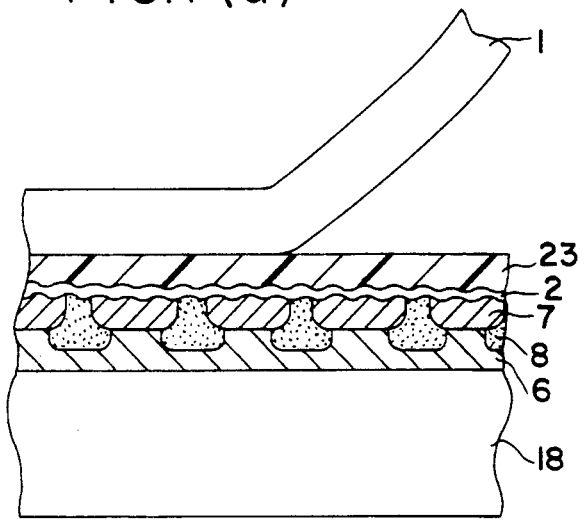
Figure 7C:
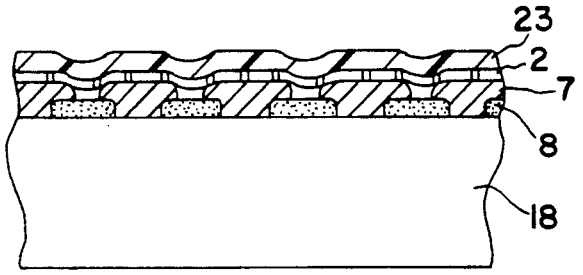

The EIGHTH EMBODIMENT will be explained by referring to FIG. 7 as follows:

In the case of the EIGHTH EMBODIMENT, a phosphor layer 7 and a black matrix layer 8 were, as shown in FIG. 7 (*a*), formed in this order on a metal film transferring sheet 24 structured as shown in FIG. 6 (*a*) of the SEVENTH EMBODIMENT to make an anode forming sheet 26. The anode forming sheet 26 was adhered via an adhesive layer 6 to a glass board 9, and then, a mold-releasable sheet 1 was peeled off as shown in FIG. 7 (*b*). Thus, the anode forming sheet 26 was exfoliated between the mold-releasable sheet 1 and a black resin layer 23. As a result, an anode having the black resin layer 23 was formed on the glass board 9. Hereinbelow, a detailed description will be made in respect to this embodiment.

Silicone film of 1 μm thick was coated on a PET film of 12 μm thick to form a mold-release layer 11, thus preparing a mold-releasable sheet 1. On this mold-release layer 11 was formed a black resin layer 23 having a thickness of 3 μm which has the following composition:

| | |
|---|---|
| Graphite | 20 weight part |
| Carbon | 5 weight part |
| Acrylic resin | 75 weight part |
| Toluene | 800 weight part |

The surface roughness of the black resin layer thus formed was 100 sec. in terms of Beck smoothness. On the black resin layer 2 was coated an aluminum film up to a thickness of 1,000 Å by vacuum evaporation to make a metal surface 2. Similar to the case of the SEVENTH EMBODIMENT, the thickness of the aluminum film was larger at the tops of peaks and smaller at the bottoms of the valleys of the surface irregularity of the black resin film 23.

In addition, the same phosphor ink as in the FOURTH EMBODIMENT was prepared, then the metal film transfer sheet 24 of FIG. 6 was fixed on the glass board, and a green phosphor pattern was printed on the metal film 2 by the gravure-offset technique. A red phosphor pattern and blue phosphor pattern were printed in positions successively to make a RGB three-color pattern. The patterns thus obtained resulted in a stripe with satisfactory uniformity, accuracy and optical characteristics.

In addition, the black matrix layer was made of the same composition as in the FOURTH EMBODIMENT and continuously printed on the metal film transferring sheet 24.

By the way as described above, a phosphor layer 7 and a black matrix layer 8 were printed on the metal film transferring sheet 24 and an acrylic adhesive was coated thereon to form a film with a uniform thickness of 3 μm thereby making an anode forming sheet 26. The anode forming sheet 26 was adhered via the adhesive layer 6 to a glass board 9 to be used as the face plate. Then, the mold-releasable sheet 1 of the anode forming sheet 26 was peeled therefrom, thereby forming the black matrix layer 8, the phosphor layer 7, the metal-backed layer 2 and the black resin layer 23 on the glass board 9. Thereafter, it was baked by elevating the temperature at 10° C./min to 450° C. and holding at this temperature for one hour. As a result, a good black matrix layer 8, phosphor layer 7, metal backed layer 2 having micro-holes and black resin film 23 could be produced and a highly performable anode could be formed after baking as shown in FIG. 7 (*c*). The anode thus obtained could provide us with suitable characteristics to be used as an anode of a cathode-ray tube. In this embodiment, it is obvious that an acrylic adhesive can be coated on a glass board to be used at the face plate.

NINTH EMBODIMENT

Figure 8A:
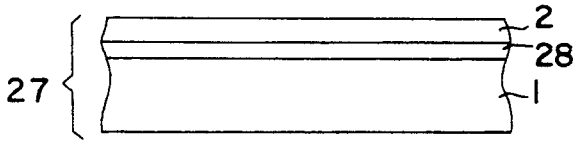
FIGS. 8 (*a*) to (*c*) illustrate an anode formation process using a metal film transferring sheet according to further another embodiment of this invention.
Figure 8B:
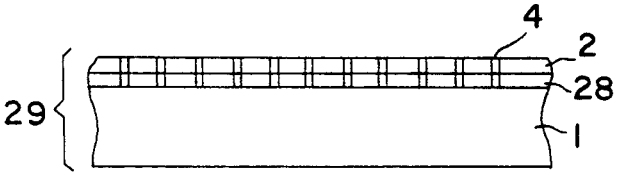
Figure 8C:
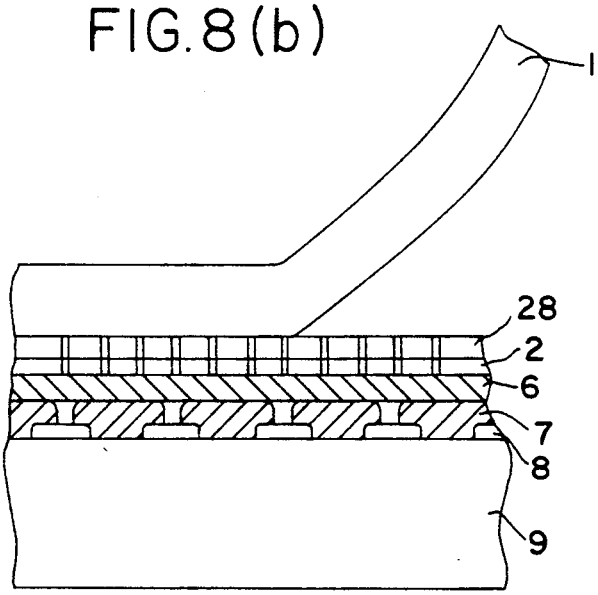

FIG. 8 (*a*) cross-sectionally shows a metal film transferring sheet 27 of another embodiment of this invention. In FIG. 8 (*a*), 1 indicates a mold-releasable sheet superior in mechanical strength and solvent resistance, and 28 indicates a black metal film which was formed by evaporating at a low vacuum degree, not to provide it with so-called metallic luster, but to make it black in color. The black metal film 28 was outstandingly effective in coping with the doming and the secondary electron beam. On the other hand, 2 indicates a metal film with a metallic luster by which a light emitted from a light emitting body is reflected by the mirror action of this metal film thereby to improve the luminance. FIG. 8 (*b*) shows a cross-sectional view of a metal film transferring sheet 29 which is made by forming micro-holes 4 in the metal films 2 and 28 of the metal film transferring sheet 27 in FIG. 8 (*a*). These micro-holes 4 are preferable to be as small-sized as possible in order to prevent a reduction in luminance. If micro-holes with an average diameter below 50 μm, preferably with an average diameter of 5 to 30 μm, were formed therein in the uniform distribution condition, in performing the baking as the final process, the generation of blisters of the metal film surface could be completely prevented, resulting in the obtainment of a highly performable metal-backed layer. FIG. 8 (*c*) shows that the metal film transferring sheet 29 shown in FIG. 8 (*b*) is adhered via the adhesive layer 6 to the glass board 9 having a black matrix layer 8 and a phosphor layer 7, and the mold-releasable sheet 1 is peeled off therefrom to transfer the black metal film 28 and metal film 2 both having formed micro-holes onto the phosphor layer 7. By the effect of the mold-releasable sheet 1, the metal films 2 and 28 were released from the metal film transferring sheet 29 to be transferred onto the phosphor layer 7, thus obtaining a metal-backed layer as an object of this invention. A detailed description will be made below on this embodiment.

The thickness of a mold-releasable sheet 1 can range from 3 to 100 μm in general, preferably ranging from 5 to 50 μm. In this embodiment, a polyimide sheet of 12 μm thick was used. Aluminum was evaporated on the mold-releasable sheet 1 at a comparatively low vacuum degree of $10^{-2}$ to $10^{-3}$ Torr to form a black metal film 28 of 800 Å thick. In addition, aluminum was evaporated on the black metal film 28 thus obtained at a higher vacuum degree of $10^{-5}$ to $10^{-6}$ Torr form a metal film 2 which is metallic, lustrous and colored in white. The method of forming micro-holes was the same as the method used in the FIRST EMBODIMENT. Cylindrical electrode 14 having micro-projections thereon was applied under pressure to the above-mentioned metal film transfer sheet 3 as shown in FIG. 2 under the discharge condition of 10 to 30 V to form micro-holes therein. The cylindrical electrode 14 was rotated and the discharge was performed three times, thus the metal film transferring sheet 3 was prepared. The metal film transferring sheet 3 thus obtained was adhered via an acrylic adhesive layer 6 to a phosphor layer 7 formed on a glass board 9 to transfer the black metal film 28 and the metallic lustrous metal film 2 both having micro-holes formed onto the phosphor layer 7. Then, the mold-releasable sheet 1 was peeled off, resulting in the formation of an anode having a metal-backed layer on the glass board 9. The anode thus formed was baked at 450° C. to thermally degrade the organic materials contained thereunder, thus forming an anode of a color cathode-ray tube.

In case that the aluminum-evaporated film has no micro-holes formed, the generation of blister was recognized all over the surface thereof. On the other hand, in the case that it has micro-holes formed by discharging, though the blister was generated when the discharge was carried out only one time, when it was carried out more than two times, a good metal-backed layer could be obtained. Particularly when it was carried out more than three times, a more stable one was obtainable. The preferable average diameter of the micro-holes was about 15 μm. If it exceeded 50 μm, a reduction in luminance resulted. The baking conditions were such that a temperature elevation of 10° C./min to 450° C. was affected and held at this temperature four one hour. As a result, if the aperture ratio of the micro-holes exceeds 5%, an outstanding metal-backed layer was obtainable.

TENTH EMBODIMENT

A metal film transferring sheet 27 obtained by the method shown in the NINTH EMBODIMENT was supportedly placed between two sand-papers (#1,000), and a rolling machine was set at a linear pressure of 4 kg/cm$^2$. The metal film transferring sheet 27 thus supportedly placed therebetween was passed five times between the rollers of the rolling machine, thus a metal film transferring sheet with micro-holes of 10 to 20 μm diameter and an aperture ratio of 10% was obtained. In addition, this metal film transferring sheet was transferred under the application of pressure onto a phosphor layer 8 formed on a glass board 9 and the baking process was carried out at 450° C. for one hour in the same way as in the THIRD EMBODIMENT. As a result, a strongly adhered, highly performable metal-backed layer was obtained.

ELEVENTH EMBODIMENT

A metal film transferring sheet 27 obtained by the method shown in the TENTH EMBODIMENT was subjected to a sandblast process using Carborundum grains of #5,000 pass (1 μm in average grain size) in a sand-blast machine made by COMCO Corp. Thus, micro-holes with an average diameter of 5 to 8 μm and an aperture ratio of 8% were formed into the metal film transferring sheet 27. It was transferred onto the surface of a phosphor layer in the same way as in the FOURTH EMBODIMENT, and the baking process was carried out at 450° C. for one hour. As a result, a strongly adhered, highly performable metal-backed layer was obtained.

TWELFTH EMBODIMENT

A metal film transferring sheet 27 made by the same way as shown in the NINTH EMBODIMENT was subjected to a discharge machining process to prepare an aluminum film transferring sheet 29 with an aperture ratio of 10%.

A phosphor composition similar to that used in the FOURTH EMBODIMENT was milled in a three-ceramic-roller mill to make a phosphor ink. The metal film transferring sheet 29 was fixed on a glass board and a green phosphor pattern was printed on the metal film transferring sheet 29 by the gravure-offset technique. A red phosphor pattern and blue phosphor pattern were printed in position in a successive manner thereby to make a RGB three-color phosphor pattern. The patterns thus printed had a stripe with satisfactory uniformity, accuracy and optical characteristics. In addition, a black matrix ink was prepared using the composition shown in the FOURTH EMBODIMENT and continuously printed on the metal film transferring sheet 29 by the same gravure-offset method as used in patterning the above-mentioned phosphor patterns. By printing a phosphor layer 7 and a black matrix layer 8 successively on the metal film transferring sheet 29, an phosphor screen forming sheet 30 was prepared. The phosphor screen forming sheet 30 was adhered to a layer of 3 μm thick formed by coating an acrylic adhesive on a glass board 9. Then, a mold-releasable sheet 1 of the metal film transferring sheet 29 was peeled therefrom in a peeling manner, so that the black matrix layer 8, the phosphor layer 7, a black metal film having micro-holes and a metal film having micro-holes could be formed on the glass board 9, thus preparing an anode. Then, the anode thus prepared was baked by heating up to 450° C. at a heating rate of 10° C./min and held at this temperature for one hour. Thus, a highly performable anode as shown in FIG. 9 (*c*) was obtained, which has suitable characteristics to be used as an anode of a color cathode-ray tube. The method of this embodiment made possible a large reduction in the number of process steps as well as a large reduction in the cost as compared with the prior art in which a phosphor screen is formed on a glass board using well-known technologies, an organic film is formed on the phosphor layer for the sake of a smooth surface formation, and the glass board having the phosphor layer and organic film is introduced into a vacuum evaporation apparatus for vacuum-evaporating an aluminum film.

What is claimed is:

1. A method of manufacturing a metal film transferring sheet comprising the steps of:

forming a metal film on a mold-releasable sheet; and forming micro-holes through said metal film by an electron discharge method.

2. A method of manufacturing a metal film transferring sheet comprising the steps of:

forming a metal film on a mold-releasable sheet; and forming micro-holes through said metal film by a sand-blast method.

3. A method of forming a metal-backed layer of a cathode-ray tube comprising the steps of:

producing a metal film transferring sheet by forming a metal film on a mold-releasable sheet, and forming micro-holes through said metal film;

forming a phosphor layer on a glass substrate;

pressing said metal film transferring sheet at a surface of said metal film to said phosphor layer via an adhesive layer to adhere said metal transferring sheet to said phosphor layer;

exfoliating said mold-releasable sheet from said metal film transferring sheet adhered to said phosphor layer to thereby obtain a metal-backed layer structure; and baking said metal-backed layer structure to remove organic components contained therein, thereby completing formation of a metal-backed layer.

4. A method of forming a metal-backed layer as claimed in claim 3, wherein each of said micro-holes has a diameter not exceeding 50 μm.

5. A method of forming a metal-backed layer as claimed in claim 3, wherein an aperture ratio of said micro-holes is not smaller than 5%.

6. An anode forming sheet which is manufactured by forming a phosphor layer and a black matrix layer on the metal film of a metal film transferring sheet comprising a mold-releasable sheet and a metal film having micro-holes formed on said mold-releasable sheet.

7. An anode forming sheet as claimed in claim 6, wherein on said black matrix layer, an adhesive layer is further formed.

8. A method of forming an anode of a cathode-ray tube comprising the steps of:

producing an anode forming sheet by forming a metal film on a mold-releasable sheet, forming micro-holes through said metal film, forming a phosphor layer on said metal film, and forming a black matrix layer on said phosphor layer;

pressing said anode forming sheet at a surface of said black matrix layer to a glass substrate via an adhesive layer to adhere said anode forming sheet to said glass substrate;

exfoliating said mold-releasable sheet from said anode forming sheet adhered to said glass substrate to thereby obtain an anode structure; and baking said anode structure to remove organic components contained therein, thereby completing formation of an anode.

9. A method of forming an anode as claimed in claim 8, wherein each of said micro-holes has a diameter not exceeding 50 μm.

10. A method of forming an anode as claimed in claim 8, wherein an aperture ratio of said micro-holes is not smaller than 5%.

11. An anode forming sheet which is manufactured by forming a phosphor layer and a black matrix layer on the metal film of a metal film transferring sheet comprising a sheet, a resin layer formed on said sheet and a metal film formed on the surface of said resin layer.

12. An anode as claimed in claim 11, wherein a pigment to be used for forming said resin layer has an average particle size not exceeding 50 μm.

13. An anode as claimed in claim 11, wherein the surface roughness of said resin layer is 400 second or less in terms of Beck smoothness.

14. An anode as claimed in claim 11, wherein a mold-release layer exists between said resin layer and said metal film.

15. An anode as claimed in claim 11, wherein on said black matrix layer, an adhesive layer is further formed.

16. A method of forming an anode of a cathode-ray tube comprising the steps of:

producing an anode forming sheet by forming a resin layer on a support sheet, forming a metal film on said resin layer, forming a phosphor layer on said metal film, and forming a black matrix layer on said phosphor layer;

pressing said anode forming sheet at a surface of said black matrix layer to a glass substrate via an adhesive layer to adhere said anode forming sheet to said glass substrate;

exfoliating said resin layer together with said support sheet from said anode forming sheet adhered to said glass substrate to thereby obtain an anode structure; and baking said anode structure to remove organic components contained therein, thereby completing formation of an anode.

17. A method of forming an anode as claimed in claim 16, wherein a pigment to be used for forming said resin layer has an average particle size not exceeding 50 μm.

18. A method of forming an anode as claimed in claim 16, wherein the surface roughness of said resin layer is 400 second or less in terms of Beck smoothness.

19. A method of forming an anode as claimed in claim 16, wherein a mold-release layer exists between said resin layer and said metal film.

20. A method of forming an anode as claimed in claim 16, wherein on said black matrix layer, an adhesive layer is further formed.

21. A method of forming a metal-backed layer of a cathode-ray tube comprising the steps of:

producing a metal film transferring sheet by forming a black resin layer on a support sheet, and forming a metal film on said black resin layer;

forming a phosphor layer on a glass substrate;

pressing said metal film transferring sheet at a surface of said metal film to said phosphor layer via an adhesive layer to adhere said metal film transferring sheet to said phosphor layer;

exfoliating said support sheet from said metal film transferring sheet adhered to said phosphor layer to thereby obtain a metal-backed layer structure; and baking said metal-backed layer structure to remove organic components contained therein, thereby completing formation of a metal-backed layer.

22. A method of forming an anode of a cathode-ray tube comprising the steps of:

producing an anode forming sheet by forming a black metal film on a mold-releasable supporting body, forming a metal film on said black metal film, forming micro-holes through both said metal film and said black metal film, forming a phosphor layer on said metal film, and forming a black matrix layer on said phosphor layer;

pressing said anode forming sheet at a surface of said black matrix layer to a glass substrate via an adhesive layer to adhere said anode forming sheet to said glass substrate;

exfoliating said mold-releasable supporting body from said anode forming sheet adhered to said glass substrate to thereby obtain an anode structure; and baking said anode structure to remove organic components contained therein, thereby completing formation of an anode.

23. A method of forming a metal-backed layer as claimed in claim 21, wherein said black resin layer contains at least graphite and carbon.

24. A method of forming a metal-backed layer as claimed in claim 21, wherein the surface roughness of said black resin layer is 400 second or less in terms of Beck smoothness.

25. A method of forming a metal-backed layer as claimed in claim 21, wherein a mold-released layer exists between said sheet and said black resin layer.

26. An anode forming sheet which is manufactured by forming a phosphor layer and a black matrix layer on the metal film of a metal film transferring sheet comprising a sheet, a black resin layer formed on said sheet and a metal film formed on the surface of said black resin layer.

27. An anode forming sheet as claimed in claim 26, wherein said black resin layer contains at least graphite and carbon.

28. An anode forming sheet as claimed in claim 26, wherein the surface roughness of said black resin layer is 400 second or less in terms of Beck smoothness.

29. An anode forming sheet as claimed in claim 26, wherein a mold-release layer exists between said sheet and said black resin layer.

30. An anode forming sheet as claimed in claim 26, wherein an adhesive layer is further formed on said black matrix layer.

31. A method of forming an anode of a cathode-ray tube comprising the steps of:

producing an anode forming sheet by forming a black resin layer on a support sheet, forming a metal film on said black resin layer, forming a phosphor layer on said metal film, and forming a black matrix layer on said phosphor layer;

pressing said anode forming sheet at a surface of said black matrix layer to a glass substrate via an adhesive layer to adhere said anode forming sheet to said glass substrate;

exfoliating said support sheet form said anode forming sheet adhered to said glass substrate to thereby obtain an anode structure; and baking said anode structure to remove organic components contained therein, thereby completing formation of an anode.

32. A method of forming an anode as claimed in claim 31, wherein said black resin layer contains at least graphite and carbon.

33. A method of forming an anode as claimed in claim 31, wherein the surface roughness of said black resin sheet is 400 second or less in terms of Beck smoothness.

34. A method of forming an anode as claimed in claim 31, wherein a mold-release layer exists between said sheet and said black resin layer.

35. A metal film transferring sheet which is manufactured by forming a black metal film having micro-holes and a metal film having micro-holes successively on a mold-releasable supporting body.

36. A metal film transferring sheet as claimed in claim 35, wherein said mold-releasable supporting body has a mold-releasable layer formed on its one surface.

37. A method of manufacturing a metal film transferring sheet comprising the steps of:

forming a black metal film on a mold-releasable supporting body;

forming a metal film on said black metal film; and forming micro-holes through both said metal film and said black metal film by an electron discharge method.

38. A method of forming a metal film transferring sheet as claimed in claim 37, wherein said mold-releasable supporting body has a mold-releasable layer formed on its one surface.

39. A method of manufacturing a metal film transferring sheet comprising the steps of:

forming a black metal film on a mold-releasable supporting body;

forming a metal film on said black metal film; and forming micro-holes through both said metal film and said black metal film by pressing thereon a projection body.

40. A method of forming a metal film transferring sheet as claimed in claim 39, wherein said mold-releasable supporting body has a mold-releasable body formed on its one surface.

41. A method of manufacturing a metal film transferring sheet comprising the steps of:

forming a black metal film on a mold-releasable supporting body;

forming a metal film on said black metal film; and forming micro-holes through both said metal film and said black metal film by a sand blast method.

42. A method of forming a metal film transferring sheet as claimed in claim 41, wherein said mold-releasable supporting body has a mold-releasable layer formed on its one surface.

43. A method of forming a metal-backed layer of a cathode-ray tube comprising the steps of:

producing a metal film transferring sheet by forming a black metal film on a mold-releasable supporting body, forming a metal film on said black metal film, and forming micro-holes through both said metal film and said black metal film;

forming a phosphor layer on a glass substrate;

pressing said metal film transferring sheet at a surface of said metal film to said phosphor layer via an adhesive layer to adhere said metal film transferring sheet to said phosphor layer;

exfoliating said mold-releasable supporting body from said metal film transferring sheet adhered to said phosphor layer to thereby obtain a metal-backed layer structure; and baking said metal-backed layer structure to remove organic components contained therein, thereby completing formation of a metal-backed layer.

44. A method of forming a metal-backed layer as claimed in claim 43, wherein said mold releasable supporting body has a mold-releasable layer formed on its one surface.

45. An anode forming sheet which is manufactured by successively forming at least a black metal film having micro-holes, a metal film having micro-holes, a phosphor layer and a black matrix layer on a mold-releasable supporting body.

46. An anode forming sheet as claimed in claim 45, wherein said mold-releasable supporting body has a mold-releasable layer formed on its one surface.

47. A method of forming an anode as claimed in claim 22, wherein said mold-releasable supporting body has a mold-releasable layer formed on its one surface.

48. A phosphor product having an anode formed by transferring the black metal film having micro-holes and the metal film having micro-holes of a metal film transferring sheet manufactured by forming a black metal film having micro-holes and a metal film having micro-holes on a mold-releasable supporting body.

49. A phosphor product as claimed in claim 48, wherein said mold-releasable supporting body has a mold release layer formed on its one surface.

* * * * *